US005267613A

United States Patent [19]

Zwart et al.

[11] Patent Number: 5,267,613

[45] Date of Patent: Dec. 7, 1993

[54] UPSTROKE JAR

[75] Inventors: Klaas J. Zwart; Colin McHardy, both of Aberdeen, Scotland

[73] Assignee: Petroline Wireline Services Limited, Aberdeen, Scotland

[21] Appl. No.: 859,581

[22] Filed: Mar. 27, 1992

[30] Foreign Application Priority Data

Mar. 28, 1991 [GB] United Kingdom ..... 9106738

[51] Int. Cl.[5] ..... E21B 31/07

[52] U.S. Cl. ..... 166/178; 175/299

[58] Field of Search ..... 166/178, 385; 175/299, 175/321; 294/86.18, 86.19, 86.23

[56] References Cited

U.S. PATENT DOCUMENTS

| | | | |
|---|---|---|---|
| 3,729,058 | 4/1973 | Roberts | 175/297 |
| 4,142,597 | 3/1979 | Johnston | 166/178 X |
| 4,607,692 | 8/1986 | Zwart | 166/178 |
| 4,694,917 | 9/1998 | Heidemann et al. | 175/299 |
| 4,919,219 | 4/1990 | Taylor | 175/299 |
| 5,022,473 | 6/1991 | Taylor | 175/299 |

FOREIGN PATENT DOCUMENTS 0121669 10/1984 European Pat. Off. .

*Primary Examiner*—Ramon S. Britts
*Assistant Examiner*—Roger J. Schoeppel
*Attorney, Agent, or Firm*—Bell, Seltzer, Park & Gibson

[57] ABSTRACT

An upstroke jar for use in downhole operations in an oil or gas well and for connection between a wireline and a tool comprises a casing defining an anvil and for connection to the tool, a hammer slidable axially within the casing for impacting with the anvil and for connection to the wireline, a hammer holder, a spring arrangement located between an abutment on the casing and an abutment on the hammer holder for compression on an operative movement of the hammer holder as a consequence of tension on the wireline and a connector releasable to free the hammer from the holder at the completion of the operative movement so that the freed hammer may impact with the anvil. The compression load on the spring present at the release is dependant on the extent of the operative movement from a rest position and the degree of compression of the spring means to obtain the operative movement. Adjustment of the release load present at the instant the hammer part is released by the connector is provided.

16 Claims, 3 Drawing Sheets

UPSTROKE JAR

FIELD OF THE INVENTION

The present invention relates to an upstroke jar for use in downhole operations in an oil or gas well.

BACKGROUND OF THE INVENTION

Mechanical upstroke jars are well established for use downhole in oil wells and serve to provide an upward jar or pull on sticking tools in the well. Operation of the jar is achieved by the use of a wireline passing down the well from a winch at the surface to a hammer part of the jar, the wireline imparting a considerable momentum force to the hammer part against spring action and which force is impacted on an anvil part of the jar. Such a jar is described in the U.S. Pat. No. 4,607,692 to Zwart, the disclosure of which is incorporated herein by reference. More specifically the jar of U.S. Pat. No. 4,607,692 comprises an outer casing housing the jar hammer part and having an upper end adapted to constitute the anvil part, the casing additionally housing a spring arrangement which includes a spring located on a spindle secured to a lower part of the casing, while a sleeve defining a hammer holder has a flange located under the spring so that the spring is located and acts between a head of the spindle and the sleeve. Connector segments connect the sleeve and the hammer part so enabling the hammer part to be pulled up by the wireline against spring action. A first recess in the casing for receiving the connector segments defines a point of release of the hammer part from the sleeve, from where the hammer part accelerates upwards to impact on the anvil part, while a second lower recess constitutes a trigger location whereat the hammer can be recoupled to the holder via the connector segments in readiness for a further jarring action. To enable different jarring forces to be produced (with wirelines of appropriate diameter present, for example in the range 2.34 mm to 2.74 mm), the jar is made adjustable by virtue of the spindle being screw positioned in the casing thereby enabling different initial compression forces to be applied to the spring. Adjustment of the spindle is effected by the fitting of a socket tool on the spindle at the lower end of the casing. However, there is the disadvantage that this adjustment cannot not be achieved readily as it is necessary to remove the tool fitted to the lower end of the jar casing before access is available enabling the socket tool to be applied to the spindle. Also, when adjusted to provide a higher load, the spring is constantly in compression, and over time the spring may be subject to creep, requiring recalibration of the adjustment mechanism if the release load is to be accurately set by an operator.

It is among the objects of the various aspects of the present invention to obviate or mitigate these disadvantages.

SUMMARY OF THE INVENTION

According to one aspect of the present invention there is provided an upstroke jar for use downhole and for connection between a wireline and a tool, the jar comprising casing means for connection to one of the wireline and the tool and defining an anvil and a first abutment, a hammer slidable axially within the casing for impacting with the anvil and for connection to the other of the wireline and the tool, a hammer holder defining a second abutment opposing said first abutment, resilient means located between the first and second abutments for compression on an operative movement of said hammer holder as a consequence of tension on said wireline, connecting means releasable to free the hammer from the holder at the completion of said operative movement, wherein the compression load on the resilient means present at release of the hammer is dependant on the extent of said operative movement from a rest position, and adjustment means for varying the extent of said operative movement so as to vary the resilient load present at the instant the hammer is released by said connecting means.

In use, the upper end of the upstroke jar, typically the upper end of the hammer, will be connected to a wireline while the lower end of the casing will be connected to a tool, either directly or through a tool connecting sub, to which a jar is to be applied.

Preferably, the adjustment means is operable from the exterior of the jar. Providing adjustment means at the periphery of the casing allows an operator to vary the release load without having to remove the tool from the jar.

Most preferably, the rest position of the hammer and the hammer holder is adjustable and is determined, at least in part, by the position of the first abutment on the casing means relative to release means provided on the casing means for cooperating with the connecting means to free the hammer from the hammer holder. This feature permits the jar to be adjusted without pre-compression of the resilient means, which is preferably in the form of a spring. Thus the spring is unlikely to be subject to creep and the like and less force is required to adjust the jar to provide a relatively high release load.

Most preferably second resilient means are provided for acting between the casing means and the hammer holder to bias the hammer holder towards the rest position.

Preferably, the adjustment means is utilised to vary the position of the first abutment on the casing means. Adjustment is preferably provided by providing the casing means in at least two axially adjustable parts, one part defining the release means and the other part defining the first abutment. Conveniently, the axially adjustable parts are screw-threaded together said one part including an internally threaded end portion and said other part including a cooperating externally threaded portion. Most preferably, the said other part defines an outer portion of the casing means and thus is externally accessible to permit rotation of the part and axial adjustment of the jar.

In the preferred embodiment the hammer holder includes a spindle extending through the resilient means and having an end member defining the second abutment. The hammer holder preferably further includes a sleeve or collar fitted to an opposite end of the spindle for releasably receiving an end portion of the hammer.

In the preferred arrangement, the resilient means comprises spring portions of different spring rate. Most preferably, the resilient means comprises separate springs, a relatively heavy rate first spring and a relatively light rate second spring, the jar being adjustable between one setting in which the operative movement is essentially accommodated by compression of the lighter second spring to provide a relatively low release load and another setting in which the operative movement is accommodated by compression of both springs. With such an arrangement it is preferable that the resilient means includes a rigid member for providing a rigid compression connection between the second abutment and the first spring on achieving a predetermined compression of the second spring to avoid the transfer of high compression forces through the second spring. The rigid member may be in the form of an axially extending sleeve or collar with the second spring being located at least partially within the collar.

In the preferred arrangement the hammer includes an elongate portion with a radially extending hammer face at a free end thereof, the other end of the elongate portion extending from the end of the casing for connection to a wireline or tool. To facilitate sliding of the hammer in the casing means, and also to maintain alignment of the hammer in the casing means, friction reducing means such as roller bearings are provided between the free end of the hammer and the casing means. The friction reducing means are preferably in the form of balls located in recesses provided in the hammer.

The casing means preferably includes release means for releasing the connecting means to free the hammer from the hammer holder at the completion of the operative movement. The release means may be in the form of a release recess. The connecting means preferably comprises at least one movable segment, the segment being receivable in the release recess on completion of the operative movement. Preferably, trigger means are also provided for reconnecting the holder to the hammer, the trigger means preferably being in the form of a trigger recess, the segment of the connecting means being receivable in the recess to permit reconnection of the hammer and the hammer holder. In the preferred arrangement, the hammer holder may be pushed to the position of the trigger means against the action of a second resilient means acting as a trigger spring.

In the preferred embodiment there is provided a locking system for the axially movable casing parts, the casing parts including overlapping portions, the locking system comprising a teeth and groove formation on an inner portion at the overlap, a through slot in the outer portion at the teeth and groove formation, a locking element insertable through the slot to engage the teeth and groove formation, the element having teeth generally complementary to the formation teeth, and retaining means for retaining the element in the slot.

The locking element preferably comprises a segment which can have an arcuate extent through any suitable angle, for example 90° and preferably the slot has a slightly greater arcuate extent to facilitate insertion and removal of the segment from the slot. The retaining means preferably comprises a sleeve which can be slid to a segment retaining position, and securing means can be provided to secure the retaining means at said segment retaining position.

According to another aspect of the present invention there is provided an upstroke mechanical jar for use in oil wells comprising casing means providing an anvil, a hammer part within the casing means for impacting with the anvil, a hammer holder for the hammer part, spring means engaged by said hammer holder so as to be compressed on an operative movement of said hammer holder, releasable connecting means between the hammer holder and the hammer part, release means in the casing for releasing said connecting means to free the hammer part from the holder at the completion of said operative movement, trigger means for reconnecting the holder to the hammer part, and adjustment means at the periphery of the casing means operable to vary the spring load (or release load) present at the instant the hammer part is released by said release means.

According to a further aspect of the present invention there is provided a downhole tool having inner and outer co-axial members which are mounted so as to permit relative axial positional adjustment, comprising a mechanism for locking the members of the tool in any one of a number of specific relative axial positions, said mechanism comprising a tooth-and-groove formation on the exterior surface of the inner member, the teeth and grooves of the formation extending in the circumferential direction and the formation having an axial extent which determines the range of specific relative axial positions in which the members can be locked, an aperture extending through the thickness of the outer member at a location thereon which exposes part of the formation in each relative axial position of the members throughout said range, a locking element releasably inserted into the aperture and having a tooth-and-groove surface which engages with the exposed part of the formation, and a sleeve axially movable over the outer surface of the outer member to overlie the aperture and to retain the element in the aperture, wherein the dimensions of the locking mechanism are such that, in use, the locking element is held against the inner member by the sleeve and is held against axial movement by the walls of the aperture, and the pitch of the teeth in the formation determine the specific relative axial positions in which the inner and outer members can be locked.

Preferably the members are screw-threaded together so that relative rotation of the members effects relative axial positional adjustment and the pitch of the screw threads is substantially greater than the pitch of the teeth in the formation.

BRIEF DESCRIPTION OF THE DRAWINGS

An embodiment of the present invention will now be described by way of example with reference to the accompanying drawings in which.

DETAILED DESCRIPTION OF THE DRAWINGS

Figure 1:
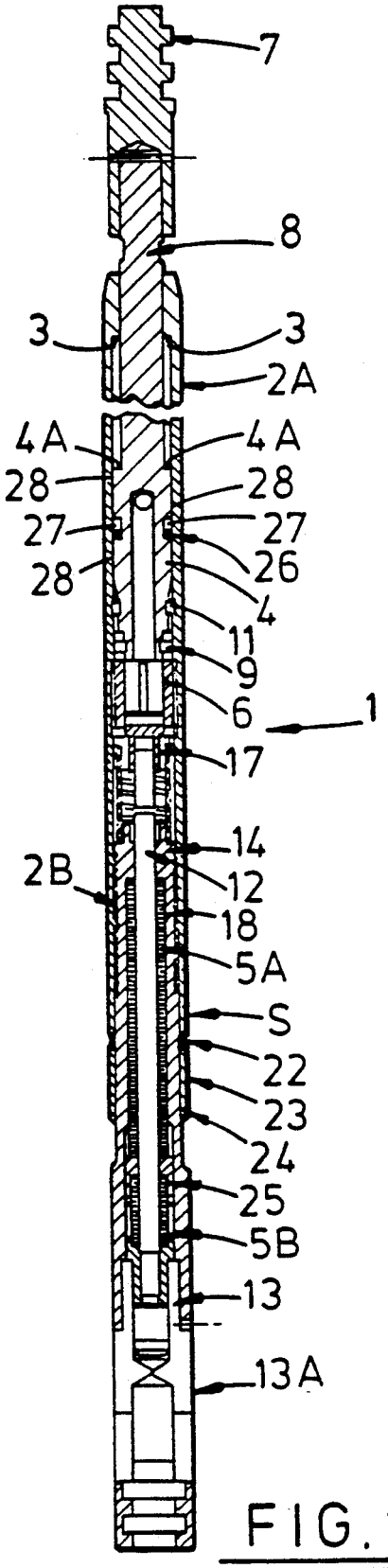
FIG. 1 shows a cross-sectional elevation of an upstroke mechanical jar in accordance with the present invention.

Referring to FIGS. 1 to 4, a mechanical upstroke jar 1 for use in the borehole of an oil or gas well has a casing 2 formed by a pair of co-axial casing parts 2A, 2B. The upper casing part 2A has its upper end adapted to provide an anvil surface 3, while a body 4 within the casing 2 defines a hammer having a hammer surface 4A for impacting with the anvil surface 3. A spring arrangement 5 is housed in the lower casing part 2B and is compressed to load the hammer 4 via a hammer holder 6 which is releasably connected to the hammer 4. Compression of the spring arrangement 5 is achieved by a wireline (not shown) which is coupled to a connector 7 secured to a shaft portion 8 of the hammer body 4 extending through the upper end of the casing 2, so that the hammer 4, together with the holder 6, can be pulled up by the wireline against the action of the spring arrangement 5. The hammer 4 is releasably secured to the holder 6 by means of segments 9 housed in slots 6A (see FIG. 3) of the holder penetrating an annulus recess 10 (FIG. 2) of the hammer.

The impacting or jarring force applied on the anvil 3 by the hammer 4 relies on the hammer being released from the holder 6 at an appropriate point when the desired spring (or release) load is achieved, and to this end release means in the form of an annulus recess 11 is present in the casing 2A to receive the segments 9 and so free the hammer 4.

To provide the pulling action on the spring arrangement 5, a spindle 12 is coupled to the holder 6 and extends centrally through the spring 5, an abutment member 13 on the bottom of the spindle engaging the bottom end of the spring arrangement 5 while the upper end of the spring arrangement 5 abuts against a lateral wall 14 provided by a collar of the casing part 2B, the spring being compressed between the abutment 13 and the wall 14. More specifically a pinned and threaded joining member 15 connects the spindle 12 to the holder 6. When the hammer 4 is released by release means 11, the hammer accelerates upwards with increasing momentum to apply a jarring blow to the anvil 3, and after the jarring impact it is necessary to reset the hammer by again coupling the hammer to the holder at a suitable trigger location. Therefore a further lower recess 16 is present on the casing 2 so that when the hammer 4 is moved downwardly, against the action of a trigger spring 17 supported on wall 14, the holder 6 with segments 9 is pushed by the hammer until the segments can penetrate the recess. The recess 10 of the hammer 4 can now align with the slot 6A of the holder 6 enabling the segments 9 to move into the recess 10, so that the hammer 4 is now triggered at the recess 16 in readiness for a further jarring action when there is an upward pull on the wireline. The wall 14 substantially avoids the ingress of debris into the zone of the spring arrangement 5.

A tool can be fitted to the jar 1 at the abutment 13 (a tool connecting sub 13A being shown in FIG. 1) and it is a particular feature of the present jar that the jar can be adjusted to provide varying release load on the hammer without first having to remove this tool or the connecting sub. In particular, this adjustment is achieved by having the casing parts 2A, 2B screw-threaded together at threading 18 at overlapping portions of the casing parts 2A, 2B whereby the casing parts 2A, 2B are relatively axially adjustable. Consequently the position of the release recess 11 relative to the rest position of the holder 6 can be varied so altering the distance the hammer 4 has to move to reach the release location and thereby varying the spring (or release) load achieved.

Figure 4:
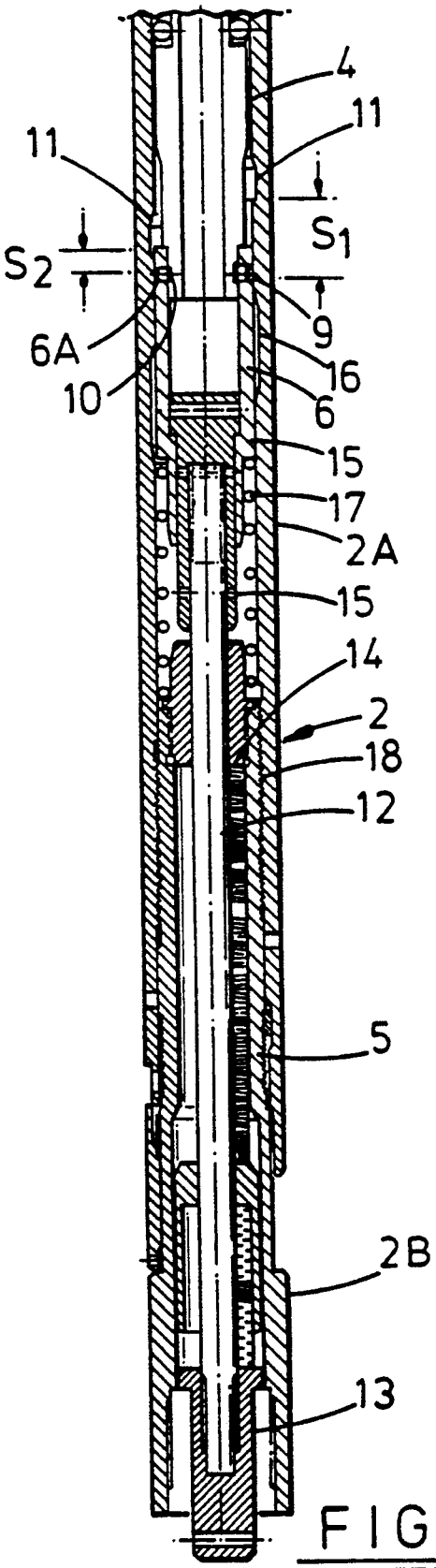
FIG. 4 shows a cross-sectional elevation of a lower part of the jar of FIG. 1 illustrating adjustment of the jar, with the one half of the section showing the jar parts in a different relative axial position from that of the other half of the section (on same sheet as FIG. 1)
Figure 3:
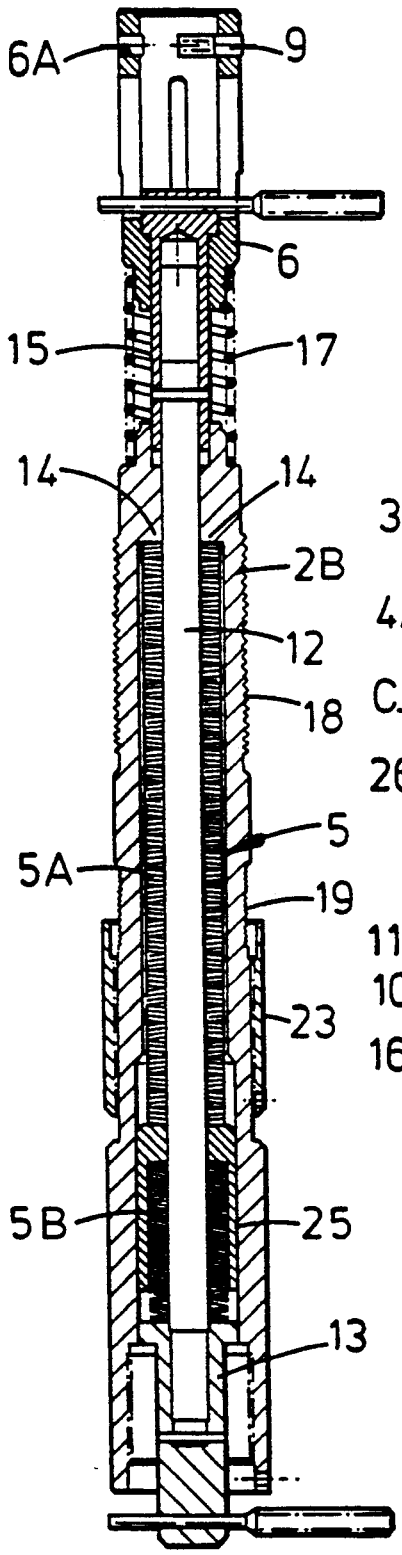
FIGS. 2 and 3 show top and bottom portions of the jar of FIG. 1 to a larger scale.
Figure 2:
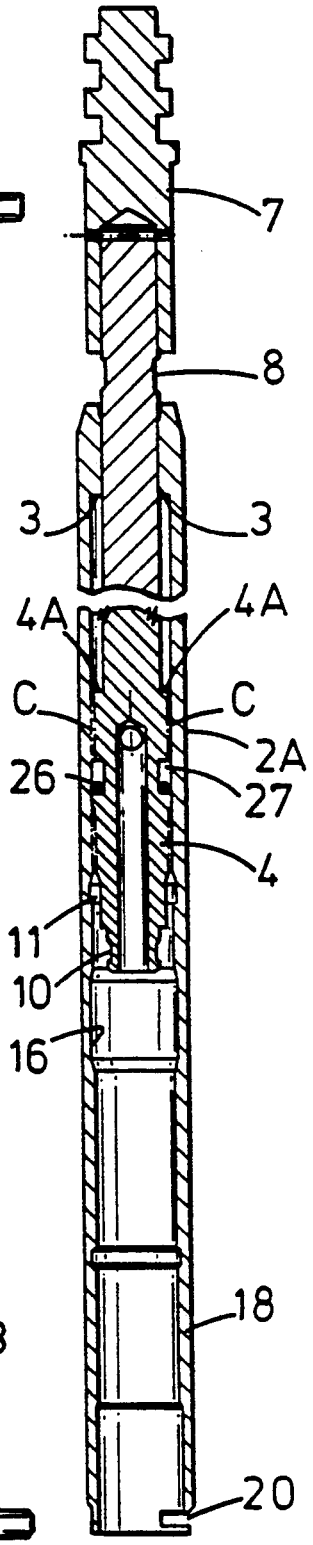
Figure 5:
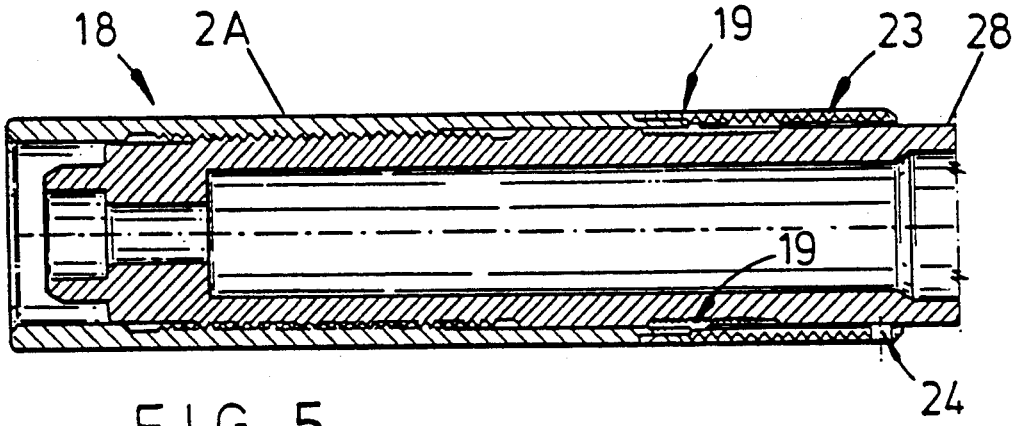
FIG. 5 is a sectional side view of part of the jar of FIG. 1 showing a locking mechanism for locking overlapping parts of the jar.
Figure 6:
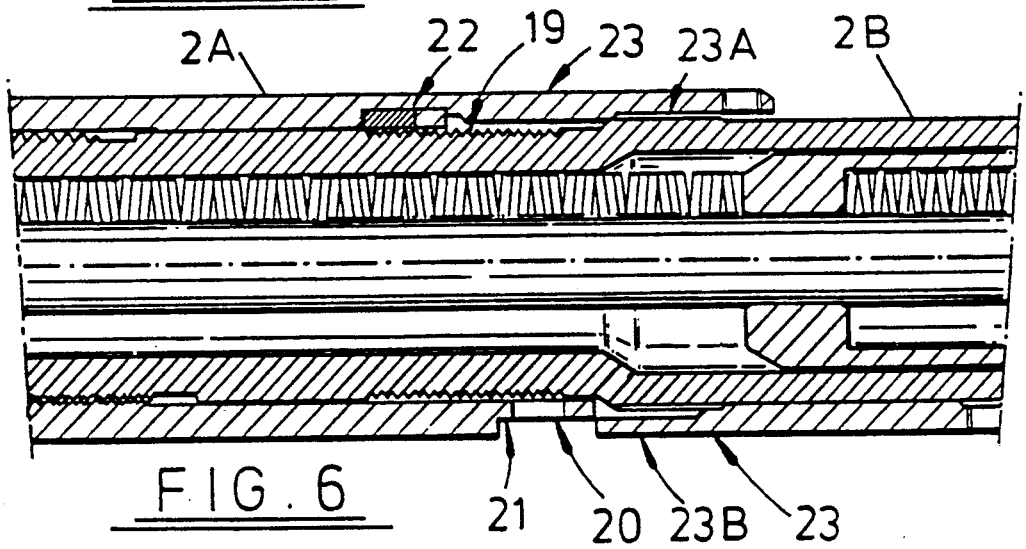
FIG. 6 illustrates the locking mechanism of the jar in greater detail with the upper half of the drawing showing the parts in a different relative axial position from that of the lower half of the drawing.

FIG. 4 of the drawings shows a cross-sectional elevation of the lower portion of the jar 1, with the right half of the section illustrating the jar adjusted to provide a maximum spring release force, whereas the left half of the section illustrates the jar adjusted to provide a minimum release force. The difference between the extents of the operative movements $S_1$, $S_2$ will be noted.

The spring arrangement 5 includes a main spring 5A to cater for heavier loading while a lighter spring 5B best handles lighter loading operations, the spring 5B being located in an inverted cup or collar 25 separating the springs. When set for minimum release load the operative movement of the hammer is accommodated substantially by compression of the lower spring 5B, while higher release loads involve compression of both springs 5A, 5B. For higher release loads the cup 25 provides a rigid compression connection between the lower abutment and the main spring 5A. The springs 5A, 5B are advantageously of the Belleville washer type. The jar 1 may include a suitable calibration scale to indicate the loading value achievable for a particular setting of the casing.

To maximise the impact force on the anvil 3 and maintain alignment of the hammer body in the casing, the hammer body 4 includes bearing means in the form of balls 26 located in an elongated annular recess 27, while the head portion 28 of the body 4 adjacent to the recess 27 is crowned to facilitate the jarring operation.

As on going jarring may be desired, it is necessary to prevent possible turning back (unscrewing) of the casing parts 2A, 2B and to this end the locking system now described is embodied in the jar.

Figure 7:
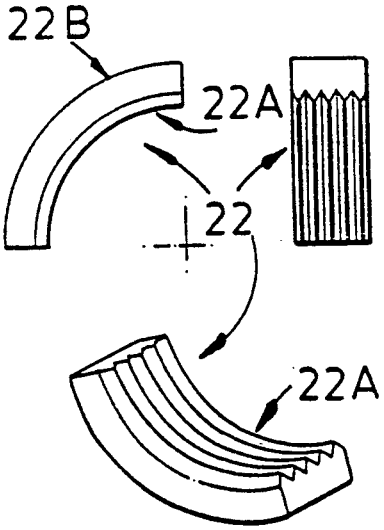
FIG. 7 shows three views of the locking element of the mechanism.

The locking system, as shown in more detail in FIGS. 5 to 8, comprises a tooth and groove formation 19 on the inner casing part 2B, a through slot 20 on a stepped portion of 21 of the part 2A, a segment 22 inserted through the slot 20 to engage the formation 19, and a retaining sleeve 23 to retain the segment in the slot 20. Formation 19 has its teeth and grooves extending in the circumferential direction and straight grooves are preferred. The axial length of the formation 19 is such that throughout the desired range of movement of the parts 2A, 2B, part of the formation 19 is exposed beneath the slot 20 so that the axial length of the formation 19 determines the range of specific relative axial positions in which the parts 2A, 2B can be locked. The slot 20 is conveniently arcuate and extends in the circumferential direction whilst the locking segment 22 is also arcuate, as shown in FIG. 7, which has an axial width dimensioned to be a sliding fit into and out of the slot 20. The circumferential extent of the segment 22 is preferably less than that of the slot 20 to ease insertion and removal of the segment 22 by hand. For example the segment may have an arcuate extent of 90° and the slot 20 may extend to 120°. The inner surface 22A of segment 22 is provided with a tooth-and-groove profile which matches that of formation 19 so that the segment 22 can engage the inner part 2B and be held against axial movement by the portions of the outer part 2A which form the circumferentially extending walls of the slot 20. The thickness of the segment 22 is dimensioned so that when it is properly seated and engaging the formation 19 its outer surface 22B is in abutment with the sleeve 23 so that the segment 22 is prevented from movement in the radial direction. The pitch of the teeth in formation 19 determine the specific positions in which the parts 2A, 2B can be locked and for this reason this pitch is substantially less than the pitch of the screw-threading 18.

This arises because segment 22 and slot 20 are dimensioned to avoid relative movement in the axial direction so that segment 22 can only seat properly on formation 19, thereby allowing sleeve 23 to function as a segment retainer, when the exposed teeth and grooves of the formation 19 are in a particular position with respect to the slot 20.

Sleeve 23 is mounted by screw-threading 23A to a part of inner part 2B which protrudes beyond the end of the outer part 2A and has a projecting portion 23B which overlies the slot 20. Slot 20 is formed in a portion of outer part 2A adjacent its lower end which is of reduced thickness and the uniform outer dimension of jar 1 is restored by the thickness of projecting portion 23B. The sleeve 23 is securable to the inner part 2 by a pin or screw at 24 when the sleeve is in its element-retaining position.

Figure 8:
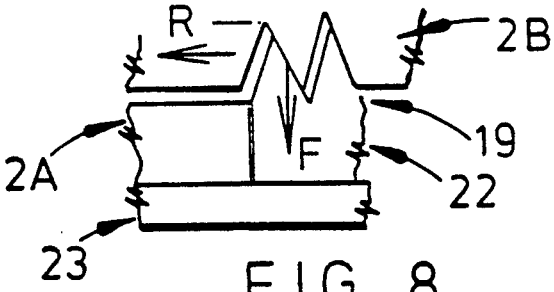
FIG. 8 schematically illustrates the locking action of the mechanism.

FIG. 8 schematically illustrates the locking action of the mechanism when the tooth profile of formation 19 is V-shaped (as is that on segment 22). Thus, any tendency for relative axial movement between part 2A, 2B permitted by the segment 22 being axially undersided with respect to the slot 20 creates an outward force F on the segment 22 by virtue of the interaction of inclined surfaces of mating teeth so that segment 22 is forced outwardly against the sleeve 23 to the extent permitted by the segment 22 being radially undersized with respect to the sleeve 23.

The above jar arrangement provides a versatile device which can be easily adjusted for varying load settings. The casing locking system can be readily released and refitted to permit conveniently, the adjusted jar setting.

A further advantage is that the springs 5A/5B can be maintained in the non-operational (steady state) mode in an uncompressed condition in contrast to the prior art jar previously described.

We claim:

1. An upstroke jar for use downhole in an oil or gas well and for connection between a wireline and a tool comprising:

(a) casing means for connection to one of the wireline and the tool and defining an anvil, the casing means being formed of at least first and second axially adjustable parts, and said second part defining a first abutment;

(b) a hammer slidable axially within the casing for impacting with the anvil and for connection to the other of the wireline and the tool;

(c) a hammer holder defining a second abutment opposing said first abutment;

(d) resilient means located between said first and second abutments compressible on movement of said hammer holder relative to said casing means from a rest position on the application of tension to wireline, said rest position of said hammer holder being determined by the position of said first abutment;

(e) connecting means releasable to free the hammer from the holder on completion of an operative movement of said hammer holder relative to said casing means on application of a predetermined compression load to said resilient means, said compression load on the resilient means at release of the hammer being dependant on the extent of said operative movement from said rest position;

(f) release means defined by said first part of the casing means for releasing the connecting means to release the hammer at the completion of said operative movement; and (g) adjustment means for relative adjustment of said first and second part of the casing means and varying the extent of said operative movement to vary the resilient load present at the instant the hammer is released by said connecting means.

2. The upstroke jar of claim 1, wherein the adjustment means is operable from the exterior of the jar while the jar is connected between a wireline and a tool.

3. The upstroke jar of claim 1, further comprising second resilient means acting between the casing means and the hammer holder to bias the hammer holder towards said rest position.

4. The upstroke jar of claim 1, further comprising locking means for locking said first and second axially adjustable parts of the casing means together at a chosen setting.

5. The upstroke jar of claim 1, wherein said first part includes an internally threaded end portion and said second part includes an externally threaded portion, said second part defining an external portion of the casing means accessible to permit rotation of said second part and axial adjustment of the jar.

6. The upstroke jar of claim 5, wherein the hammer holder includes a spindle extending through the resilient means and having an end member defining said second abutment and a sleeve fixed to an opposite end of said spindle for releasably receiving an end portion of the hammer.

7. The upstroke jar of claim 5, wherein the mechanism for locking the first and second parts of the casing means at a chosen setting comprises a tooth-and-groove formation on the exterior surface of the inner portion of said second part, the teeth and grooves of the formation extending in the circumferential direction and the formation having an axial extent which determines the range of specific relative axial positions in which the first and second parts can be locked.

an aperture extending through the thickness of the outer portion of said first part at a location thereon which exposes part of the formation in each relative axial position of the parts throughout said range, locking element releasably inserted into the aperture and having a tooth-and-groove surface which engages with the exposed part of the formation, and a sleeve axially movable over the outer surface of the outer portion to overlie the aperture and to retain the element in the aperture, wherein the dimensions of the locking mechanism are such that, in use, the locking element is held against axial movement by the walls of the aperture, and the pitch of the teeth in the formation determine the specific relative axial positions in which the inner and outer portions and thus the parts of the casing means can be locked.

8. The upstroke jar of claim 1, wherein the resilient means comprises spring portions of different spring rate.

9. The upstroke jar of claim 8, wherein the resilient means comprises separate springs, a relatively heavy rate first spring and a relatively light rate second spring, the jar being adjustable between one setting in which the operative movement is substantially accommodated by compression of said second spring to provide a relatively low release load and another setting in which the operative movement is accommodated by compression of both springs.

10. The upstroke jar of claim 9, wherein the resilient means includes a rigid member for providing a rigid compression connection between said second abutment and said first spring on reaching a predetermined compression of said second spring.

11. The upstroke jar of claim 1, wherein the hammer includes an elongate portion with a radially extending hammer face at a free end thereof, the other end of the elongate portion extending from the casing means for connection to a wireline or tool, and wherein friction reducing means are provided between the free end of the hammer and the casing means.

12. The upstroke jar of claim 1, wherein the connecting means comprises at least one movable segment for connection of the hammer to the hammer holder, and the release means is a release recess, the segment being receivable in said recess on completion of said operative movement to free the hammer from the hammer holder.

13. The upstroke jar of claim 12, further comprising trigger means for reconnecting the holder to the hammer.

14. The upstroke jar of claim 13, wherein the casing means defines trigger means in the form of a trigger recess, the segment of said connecting means being receivable in said recess to permit reconnection of the hammer and the hammer holder.

15. The upstroke jar of claim 1, wherein the resilient means is uncompressed when said hammer holder is in said rest position.

16. An upstroke jar for use downhole in an oil or gas well comprising:

(a) casing means providing an anvil;

(b) a hammer part within the casing means for impacting with the anvil;

(c) a hammer holder for the hammer part;

(d) spring means mounted to the casing means and engaged by the hammer holder and compressible on an operative movement of said hammer holder;

(e) releasable connecting means between the hammer holder and the hammer part;

(f) release means in the casing means for releasing said connecting means to free the hammer part from the holder at the completion of the operative movement;

(g) trigger means for reconnecting the holder to the hammer part; and (h) adjustment means defining an external portion of the casing means and operable for varying the release load present at the instant the hammer part is released by said release means.

* * * * *